United States Patent [19]

Ghoneim

[11] Patent Number: 4,526,350

[45] Date of Patent: Jul. 2, 1985

[54] WASTE GAS COLLECTION DEVICE

[76] Inventor: Salah Ghoneim, 1245 Elkhorn Cres., Prince George, B.C., Canada, V2M 6J2

[21] Appl. No.: 546,526

[22] Filed: Oct. 28, 1983

[51] Int. Cl.[3] ..... C21C 5/38

[52] U.S. Cl. ..... 266/159; 266/145

[58] Field of Search ..... 266/159, 158, 145

[56] References Cited

U.S. PATENT DOCUMENTS

| | | | |
|---|---|---|---|
| 2,184,297 | 12/1939 | Grindle | 266/159 |
| 3,727,587 | 4/1973 | Nebgen | 266/158 |
| 3,758,089 | 9/1973 | Kocks | 266/159 |
| 3,848,860 | 11/1974 | Maeda et al. | 266/158 |
| 3,963,416 | 6/1976 | Mach | 266/145 |
| 4,106,758 | 8/1978 | Leroy et al. | 266/158 |
| 4,129,288 | 12/1978 | Laimer et al. | 266/158 |
| 4,190,237 | 2/1980 | Baum | 266/158 |

*Primary Examiner*—L. Dewayne Rutledge
*Assistant Examiner*—S. Kastler
*Attorney, Agent, or Firm*—Leonard Bloom

[57] ABSTRACT

A push-pull exhaust scavenging system for removal of noxious fumes emanating from the mouth of metalurgical vessels known as converters. The converter, configured as a drum disposed for rotation about the elongate longitudinal axis includes a mouth opening and an instrumentality for moving the converter mouth from a plurality of positions so as to effect the addition and deletion of substances within the converter. Conventional gas hood in overlying registry with the converter mouth allows exhaust gases to be scavenged from the converter during one state of the converter process, but rotation of the converter mouth away from the conventional gas hood requires the exhaust and intake manifold according to the instant invention including positive and negative air flow for forcing air into the exhaust conduit system. An additional exhaust conduit is provided above the conventional gas hood for further improved scavenging.

16 Claims, 6 Drawing Figures

WASTE GAS COLLECTION DEVICE

BACKGROUND OF THE INVENTION

This invention relates to a means for capturing toxic waste gases formed as byproducts during metalurgical processes in converters. More particularly, the device to be described hereinafter is adapted to be used with a converter of drum shaped configuration, and suitably supported on rollers and gear driven to move in an arcuate manner between one of four positions describing an arc. The motor range is from 0° to 180°, defined by motion of the mouth of the converter with 0° being the topmost point of the converter. As a practical matter, the range of motion is preferred to be between 0° and 135° to receive or to discharge material.

One of the most vexing problems from not only an environmental point of view, but also to minimize workplace contamination from deadly toxic waste fumes during certain conversion processes is capturing waste gases from extremely hot furnaces. Vessels used in metalurgy operate at exceeding high temperatures within a refractory environment up to 1300° Centigrade and the expulsion of toxic gases from the molten constituents is not uncommon.

Common operations associated with metalurgical conversion processes includes allowing the converter to discharge all or a portion of its contents from a previous conversion run, orientation of the converter vessel to receive one or more components for subsequent conversion and a reaction step in which tuyeres or their equivalent are caused to blow enough volume of air which react with the constituents in the converter and elevate the temperature.

The following citations reflect the state of the art of which applicant is aware in so far as these patents appear to be germane to the patent process at hand:

U.S. Pat. No. 3,365,340—Tisdale
U.S. Pat. No. 3,727,587—Nebgen
U.S. Pat. No. 4,106,758—Leroy et al.
U.S. Pat. No. 4,129,283—Laimer et al.
U.S. Pat. No. 4,190,237—Baum The patent to Baum is of interest since he teaches the use of a method for treating waste gases emitted from a converter wherein both a waste gas cooler and dust separator are utilized. Particularly, Baum is concerned with the discharge of carbon monoxide into the atmosphere and proposes as a solution therefor an arrangement for minimizing the amount of atmospheric air that can be mixed with the exhaust gases by containing the exhaust gases in a fairly constricted environment as shown in the drawing figures. More particularly, the contents of the refining vessel is kept substantially excluded from the environment until the pouring or the addition of further materials, and a rather cumbersome shroud 1 or pressure vessel is required to effect a substantially gas tight connection, the device obviously being somewhat cumbersome and requiring substantial manipulation to utilize same since Baum reduces the amount of atmospheric air associated with the waste gas. This citation requires that the refining be done under pressure and therefor has an associated gas tight seal as a result.

The patent to Leroy et al discloses a converter for refinement of liquid metal wherein two gas scavenging devices 14, 17 are provided for the subsequent disposition of the waste gases. This citation uses a converter for refining liquid metal of substantially cylindrical configuration having closed end walls and an opening in the circumference thereof, the body being arranged with an horizontal axis and being rotatable thereabout.

Regarding the exhaust scavenging, in one position "or the normal position" an opening lies in substantial registry with the first device 14 for collection of gases, and the second gas collection device 17 is oriented to receive the vapor from the converter when in a second position as shown in FIG. 2.

Nebgen relates to a copper converter wherein gaseous products produced during the burning of copper sulfide to sulphur dioxide are conducted through a tight air hood wherein both heat and recoverable constituents in the waste gases are obtained. A cursory review of this citation makes it evident that the gases can only be scavenged from one position of the converter relative to the exhaust flue.

Laimer et al. shows a metalurgical vessel having a hood for diverting flue gases and smoke to a remote area to avoid contamination. As should be evident, the outlet spout is provided with a covering and an associated shroud to assist in gas migration through conduits 25 for example, the opening 21 and the need to have access to a portion exterior the shroud allows the amount of waste gases entering the environment to perhaps be reduced, but only at the cumbersome expense of providing a recess within which the pouring and ladling off can occur in a sealed or closed manner as suggested in column 1 lines 44–52.

Moreover, the actual observation of ladling from the vessel to another container, since it occurs in a closed environment requires a viewing port or remote television camera to monitor same, and the smoking gases associated with the transfer would appear to hamper the visual process.

Tisdale shows the state of the art further, and more particularly a basic oxygen furnace wherein fumes containing iron oxide are directed into a hood 2 and through a duct 3 to impinge on slag contained within an acid air furnace 6. Note that after the fumes impinge on the slag they flow into a waste heat chamber 15 and into a spray chamber 19 wherein the fumes are cooled and cleaned of dust.

By way of contrast, the instant application is distinguished over the known prior art in that an instrumentality has been provided which lends itself to disposition on cylindrical or drum shaped converters which are adapted to move in arcuate fashion from a first to a plurality of further positions. An opening associated with the migration of metals, slag, etc. associated with processes earmarked for the converter address the converter mouth during various angles of orientation of the converter offset from a vertical plane, in which the centerline of the opening is coincident with a vertical plane. An instrumentality is provided which is carried upon the converter proper and can travel with the converter in its several various postures and provide a sufficient air flow and circulation to facilitate the migration of noxious and toxic fumes out of the environment and the work place into a station remote therefrom for subsequent treating.

More particularly, a conduit means is adapted to communicate adjacent the opening of the converter at one edge and a source of air pressure is adapted to pass a volume of air from this one side edge of the converter mouth to another. The other side edge of the converter remote from inlet air pressure has a negative pressure area communicating with a further conduit which encourages the migration of exhaust gases from the mouth of the converter thereto and to subsequent treatment downstream. This defines a "push-pull" air flow system.

Since the converter moves from at least one position to a plurality of further positions, the conduits associated with the converter and defining the "push-pull" system similarly need the requisite flexability to move in an arc of circle corresponding to the degree of rotation of the converter so that the air flow and exhaust gas scavenging can occur during all aspects of the converter orientation. To this end, the inlet duct is provided with a flexible instrumentality to allow deformation of the flexible portion thereby allowing the inlet duct to assume a plurality of angulations. The exhaust duct has a swivel portion coincident with the axis of rotation of the converter and a portion of the exhaust duct instrumentality operates and rotates in concert with the converter. Various structural nuances associated with the apparatus according to the instant invention will become evident.

OBJECTS AND SUMMARY OF THE INVENTION

Accordingly, this invention has as an object the provision of an improved exhaust gas collection device used particularly with converters.

A primary object of this invention is to provide a device which improves the scavenging of exhaust gases found from metalurgical vessels known as converter, and removing these toxic waste gases to further treatment without posing a threat to occupants within the plant associated with the metalurgical converter's or the environment.

It is yet a further object of this invention to provide a device as characterized above which can move and be oriented during various plural orientations of the converters mouth so that the waste gases that emanate from the mouth at all positions of the converter can be scavenged by the improved waste gas system.

It is yet a further object of this invention to provide a device as characterized above which is suitably fabricated to handle extremely high temperature, corrosive gases, removing them from the vessel environment and providing subsequent treatment of the gases downstream thereof.

It is yet a further object of this invention to provide a device as characterized above which is extremely efficient in operation, durable in construction, and safe to use.

It is yet a further object of this invention to provide a device as characterized above in which the flow rate of the waste gas collecting device of the present invention can be altered to accommodate various demand situations during the course of the converter operation.

A still further object contemplates providing both positive and negative fluid flow in respective conduits spaced over a converter mouth to provide a "push-pull" effect.

These and other objects will be made manifest when considering the following detailed specification when taken in conjunction with the appended drawing figures.

BRIEF DESCRIPTION OF THE PREFERRED EMBODIMENT

Figure 1:
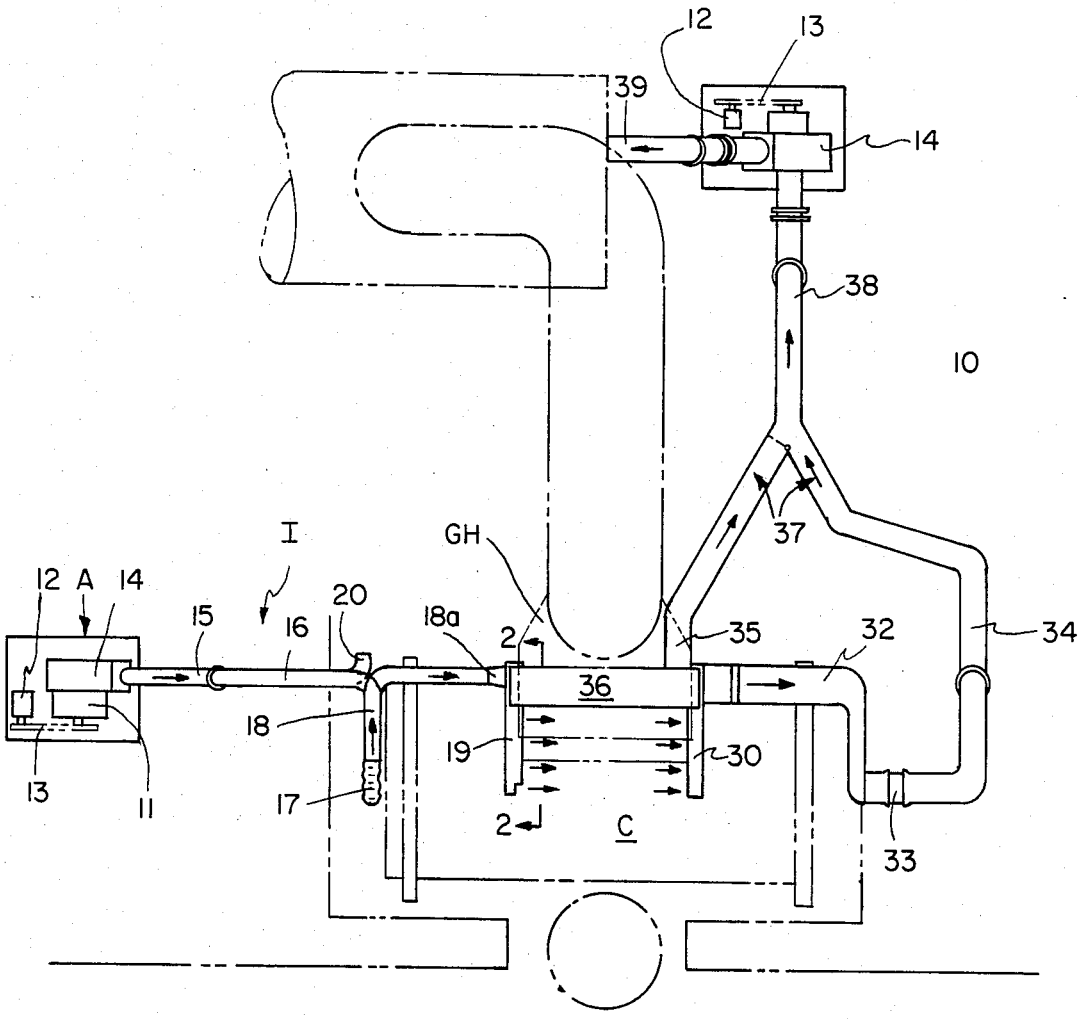
FIG. 1 is a top plan schematic view of the apparatus according to the present invention.

Referring to the drawings now wherein like reference numerals refer to like parts throughout the various drawing figures, reference numeral 10 is directed to the waste gas collector to be used with metalurgical vessels known as converters according to the present invention.

More particularly, the waste gas collecting device according to the instant invention is provided with two air systems, one of which includes a duct adapted to supply air immediately adjacent the mouth of the converter and another duct is adapted to scavenge toxic gas and supplied air on an opposite side of the converter mouth and process the scavenged air and waste gas at an area remote therefrom. A secondary system is placed above the conventional hood GH to pull any escaped gases from the hood GH.

By way of background, the converter to which this application is specifically addressed is known as a Pierce-Smith unit, is substantially cylindrical in configuration having closed end walls and has along one annular surface thereof one opening defining a converter mouth. The converter is suitably formed with a steel outer shell with refractory material on an inner shell wall and is provided with tuyeres in sufficient numbers to supply enough airflow to cause a thermal reaction with material in the converter. More particularly, the converting cycle generally follows the following operating procedure: a substantial portion (about 20 tons) of "dry finish" remain in the converter from a previous charge, and to this are added ninty to a hundred tons of settler matte. The converter is turned "on-tuyeres" and four tons of gravel flux are charged. After forty minutes of blowing air from the tuyeres, and a temperature of 1220°-1230° Centigrade is reached, the converter is turned down and following a settling period of a few minutes, a portion of the slag thus formed is skimmed from the converter, which defines a first angle about which the converter rotates so that a fraction of the contents can be poured off, approximately forty tons removed at that time. Additional settler matte and six to eight tons of flux are added into the converter and a second on-tuyeres blow begins until the temperature rises to 1225°-1235° centrigrade, the converter is again turned down for slag removal. This defines a second rotation of the converter from the on-tuyeres condition in which the mouth of the converter is substantially at the top of the drum. As the cycle progresses, the fluidity of the slag is controlled by gradually increasing its silica content to 26-27% by weight and the temperature is allowed to rise to 1260°-1270° centrigrade. When the constituent components within the converter have the requisite characteristics the cycle is adapted to recommence with the converter being emptied of all but about twenty tons of "dry finish". Thus, there are at least two blowing or reaction stages with the tuyeres-on, with a waiting cycle to allow some of the matte to settle and then a slag skimming operation prior to the final pouring of the matte.

Figure 2:
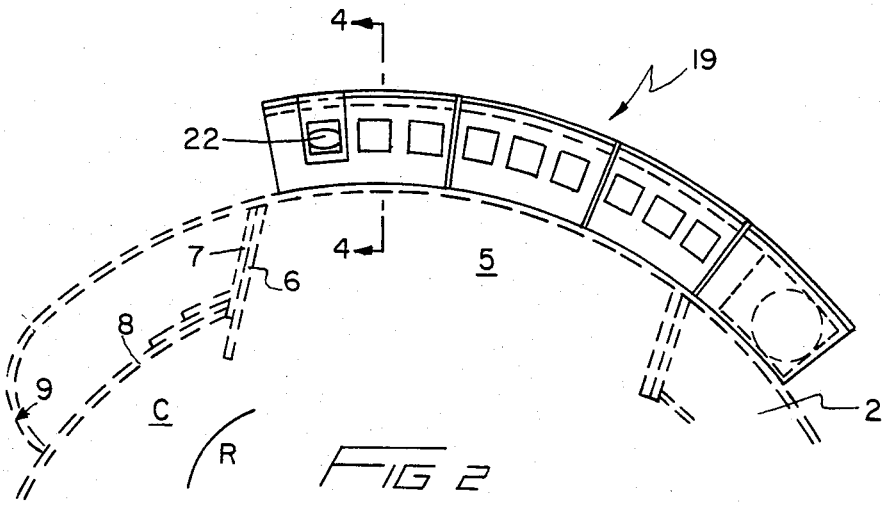
FIG. 2 is a sectional view of FIG. 1 taken along lines 2—2 thereof.
Figure 3:
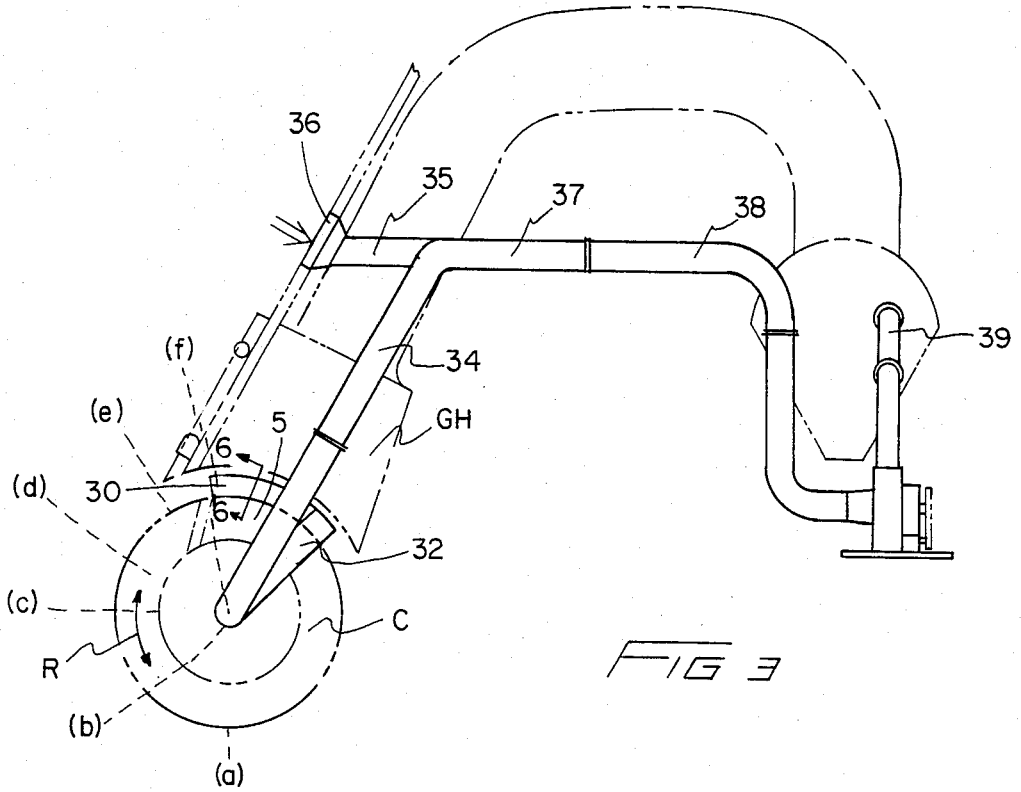
FIG. 3 is a sectional elevation of FIG. 1 from the right hand side thereof.

It should be evident that when the converter is oriented so that the mouth of the converter is in a substantially horizontal plane or at least facing upwards and is on the topmost part of the drum, a stationary exhaust gas receiver placed with a conventional hood above the opening accommodates gases emanating therefrom. FIGS. 1 and 3 show a conventional gas hood GH which receives gas from the converter mouth at this time. It is when the converter rotates to a further position that it is difficult to have the conventional stationary gas hood accommodate exhaust gases spewed therefrom, and to which purpose the instant invention is directed. More particularly, the conventional converter C is shown diagrammatically in the drawing figures as substantially cylindrical in shape having closed end walls, and the converter C is typically mounted on trunnions and has an external ring gear operated by a further gear (not shown) for rotation of the converter C in the direction of the arrows R. Appropriate ladles adapted to receive the contents of the converter are not shown, but are used to remove the contents from the converter and placed at a remote site. As shown in FIG. 2, the converter C includes a throat opening or mouth 5, a lip liner 6, a stack liner base 7, a peripheral riding ring 2 and a cable guard 9 so that the actual outer shell 8 of the converter C can be allowed to operate from the plural positions and be allowed to receive and discharge the material through the mouth opening 5.

FIGS. 1, 2, 4 and 5 are directed to certain details of the inlet station which direct supplied air over the mouth 5 of the converter C and will now be described as follows. The intake area I as shown in FIG. 1 includes at one end an air pump 11, a pump motor 12 and a belt 13 interconnecting the pump with the motor so that rotation of the motor 12 and its transferal through the belt 13 to the pump 11 causes air to be induced into a pump chamber 14 and thence forward through a conduit system 15. Typically, the pump 11 and associated housing take the form of a fan so that air entering in the direction of the arrow A is first filtered and then advanced into the conduit system 15. As shown, the duct 15 communicates with a further upwardly inclinated duct 16 which in turn attaches to a manifold 19 mounted on the converter C and its associated intake pipe 18 thereto by means of a flexible hose 17 whereby rotation of the manifold 19 and its associated pipe, 18 relative to the pipe 16 is possible through the flexible hose 17. As is to be noted, since the temperatures associated with the incoming gases are relatively low, the flexible section 17 is quite adequate for the purposes. However, if the incoming gases were to include a corrosive fluid, a different connecting tube would be used as will be shown later. As shown in FIGS. 1 and 3, the gas hood GH when adapted to directly overlie the mouth 5 of the converter C will do an adequate job of scavenging the exhaust gases from the converter. However, it is during periods of rotation of the converter in the direction of the arrow R that provides the waste gases with the opportunity to escape to the environment. Thus, it should be seen that with the manifold 19 attached to the converter C and when operatively coupled to the air A with the flexible conduit 17, the manifold 19 can travel with the converter and provide a steady outflow of air or other fluid as is necessary. When all air is not required to be discharged from the manifold 19, a diverting conduit 20 provided with a pneumatically controlled damper is used to divert air flow or reduce the air pressure which is delivered through the manifold 19. Thus, air is adapted to be supplied as needed. As shown, the conduit 18 connecting the manifold with the flexible section 17 is substantially L-shaped and has a flared portion 18*a* immediately adjacent the manifold to provide a smooth air flow between the two components.

Figure 4:
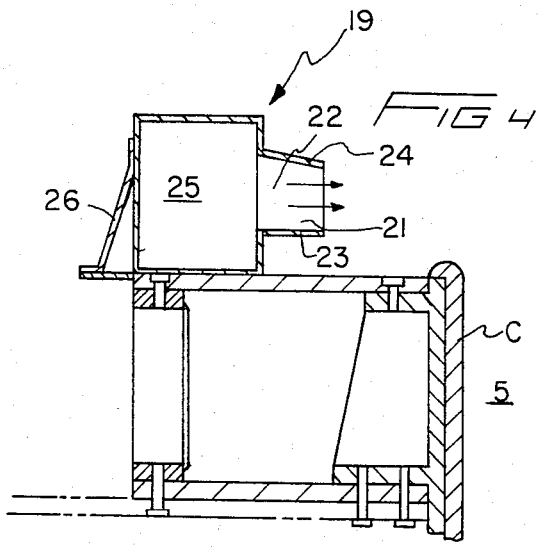
FIG. 4 is a sectional view taken along lines 4—4 of FIG. 2.
Figure 5:
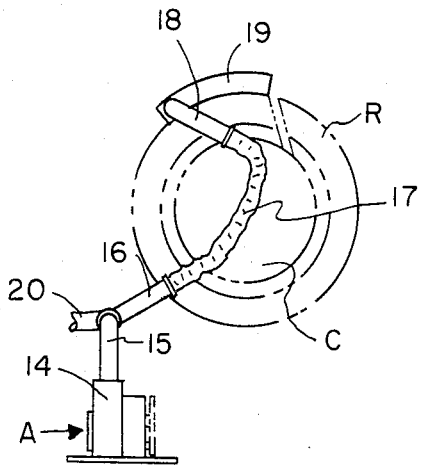
FIG. 5 is an end view taken along the left hand side of FIG. 1.

The manifold itself is best seen in FIG. 4 and includes an outlet defining a nozzle 21 formed from a horizontal lower member 23, side walls 22 and a tapered upper member 24 which allows a well controlled airflow from a main manifold chamber 25. The main chamber 25 is of substantially rectangular section and includes upper and lower walls, and a wall opposite the outlet 21. Appropriate bracing 26 allows the manifold 19 to be supported on the converter C as shown in FIG. 4.

Figure 6:
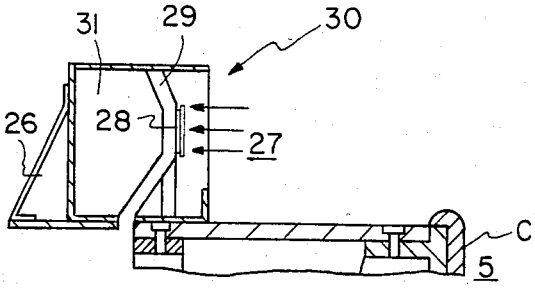
FIG. 6 is a sectional view taken along lines 6—6 of FIG. 3.

On the other edge of the converter mouth 5 remote from the air supplying manifold 19 there is further provided an exhaust manifold 30 which as shown in FIG. 1 receives air and exhaust gases carried over the mouth 5 of the converter C. FIG. 6 illustrates the ingress of waste gases through a portal 27 which is faced with adjustable baffles 28 to increase the pick-up velocity of the exhaust gas manifold 30. These baffles 28 are supported by a ventilating system 29 at intervals of an interior housing 31. Interior housing 31 is a housing of substantially rectangular duct section having upper and lower walls, a side wall and an open end wall to induce toxic waste fumes. Similar to FIG. 4, a brace member 26 is provided remote from the mouth of the converter 5 to support the exhaust duct 31.

Thus, the exhaust manifold 30 receives waste fumes through the portal 27 assisted by adjustable baffles 28 to induce those fumes into the exhaust duct 31 which communicates via L-shaped conduit 32 with a means for treating the exhaust gas at a remote area. More particularly, a swivel 33 is provided which is symmetrical with the axis of rotation of the drum C, the swivel allowing a fluid tight seal of the exhaust gases as the gases leave the L-shaped duct 32 and thence onward to the exhaust gas treatment are via conduit 34. Thus, the swivel 33 allows articulation of the L-shaped duct 32 relative to the duct 34.

FIG. 3 shows various orientations of the mouth 5 of the converter C and the manner in which the ducts serve to take the exhaust waste gases from the converter. In the orientation shown in FIG. 3 in which the mouth 5 defined by the subtended angle between extended lines (a) and (b) on an opposed peripheral arc of the drum as shown in the drawings, the mouth of the converter is centrally disposed under the gas hood GH and the gas hood's downcomer receives waste gases blowing therein. The angle of arc subtended by the dash lines (e)-(f) constitutes an angle of orientation of a converter in which the gases are not blowing directly into the downcomer of the gas hood GH but a portion of the gases is blowing up and outwardly. In this position a portion of the gas will spill upwardly and outside of the downcomer and for this purpose, the exhaust fume conduit of another form of the invention has been created. As shown in FIG. 3 for example, the escaped exhaust fumes conduit is provided with gases encouraged to enter into the conduit 35 via its associated converging fume extractor 35 and thereafter is adapted to communicate through a conduit Y-section 37 to the other conduit 34 migrating to the waste gas treatment means. The Y-shaped conduit 37 provided with a pneumatically adjustable damper to control the induced volume of waste gases into 30 and 36 to correspond to the supplied air pressure from outlet 21 in accordance with the rotation of the converter mouth 5. A conduit 38 receives gas coming from conduits 34 and 35 via 37 due to a negative air pressure provided by a further motor 12 which runs a pump or fan 14 through belt 13 and feeds the gases via conduit 39 into the treatment area shared with the gas hood GH.

Thus, an effective push-pull system is provided in which incoming air I is pushed over the converter mouth and a pulling system exists from the Y-shaped conduit 37 through not only the upper fume extractor 36 but also through the manifold 30 so that exhaust gases emanating have little choice but to be accommodated by the exhaust gas retrieval system 10.

As shown in FIG. 3 when the converter can also have its mouth 5 oriented by further rotation so that it resides between the angle subtended by the chords (d)-(e), the tuyeres become off and the converter is waiting for a charge of new material. The converter may also be oriented throughout an angle subtended by the chords (c)-(d) which corresponds to a stage preparatory to pouring in which the tuyeres are off and the molten metal within the converter is allowed to stratify and a last position denoted between the subtended angle (b)-(c) corresponds to the pouring process in which a portion of the molten metal within the converter is discharged and defines either skimming slag or casting a finished matte.

Thus, it should be clear that when the converter mouth has moved counter-clockwise beyond the ray (f) only the apparatus according to the instant application provides the scavenging and waste gas evacuation that is essential for the production of and maintenance of safe atmospheric conditions within the foundry or metal extraction and purification plant within which the converter resides.

Having thus described the preferred embodiment of the invention, it should be understood that numerous structural modifications and adaptations may be resorted to without departing from the spirit of the invention.

What is claimed is:

1. A waste gas scavenging device for use with converters having molten metal and chemical reagents contained therewithin, which molten metal and chemical reagents expel noxious gases to the environment, the converter having a mouth, the waste gas scavenging system comprising in combination:

means adjacent the mouth of the converter for extracting exhaust gases and ambient air from the environs of the mouth, said extracting means adapted to route the exhaust gases to a site remote therefrom for subsequent processing, and means operatively associated with said exhaust extracting means so that said exhaust extracting means can operate in concert with rotation of the converter whereby the relationship of the mouth of the converter to said exhaust extracting means is the same during all angles of rotation of the converter including a source of incoming air and intake means disposed adjacent the mouth for providing air current flow from said intake means to said exhaust extracting means defining a push-pull system wherein said intake means includes means for allowing the relationship of said intake means relative to the converter mouth to remain constant during rotation of the converter wherein said exhaust extracting means includes a branch exhaust conduit disposed above a conventional stationary gas hood for extracting fumes which meander beyond the mouth of the converter wherein said further branch exhaust conduit communicates with said exhaust extracting means downstream thereof for subsequent processing in an area remote from the converter, said exhaust extracting means sharing scavenging cleansing facilities with the conventional gas hood wherein said intake means comprises a manifold having a plurality of openings, said manifold adjacent an edge of the converter mouth, said manifold communicating with a conduit system to a source of air wherein said conduit system includes a flexible section whereby rotation of the converter is met with concomitant deformation of said flexible conduit section wherein said exhaust extracting means includes an exhaust manifold disposed adjacent the edge of the converter diametrically opposite said intake means wherein said exhaust manifold communicates with an exhaust conduit section including a swivel connector integrally formed with an exhaust conduit system, and swivel connector allowing rotation of said exhaust conduit section on the converter relative to a stationary exhaust conduit, said swivel disposed on an axis coincident with the axis of rotation of the converter wherein said air intake means includes a bypass for selectively disabling said intake air means during certain phases of the converting process wherein said intake means includes a source of fluid pressure including a pump and a motor driving said pump through a belt means wherein said exhaust extracting means includes a pump to extract air and a motor to drive said pump operatively connected to said pump by a belt wherein said intake means includes a manifold of substantially elongate rectangular section formed as an arcuate conduit having the same radius of curvature as the converter, said rectangular section having a top wall, a bottom wall and a side wall, a face opposite said side wall provided with a nozzle opening wherein said nozzle opening includes a bottom wall, a pair of side walls and a downwardly declinated top wall inclined downwardly towards the converter mouth wherein said exhaust manifold includes an arcuate conduit having substantially rectangular cross-section including a top wall, a bottom wall, a side wall, a side opposite said side wall provided with a wall brace and an opening, whereby air pressure causes exhaust gases to enter therein including baffle means in said exhaust extracting means to alter flow rate therethrough as a function of converter position.

2. The device of claim 1 including damper means on said manifolds to alter flow patterns.

3. The device of claim 2 wherein said manifolds includes bracing means attaching said manifolds to the converter.

4. A waste gas scavenging device for use with Pierce-Smith type converters having a stationary conventional overhead hood to vacuum spouting toxic fumes containing impurities such as sulfur dioxide from a mouth on an annular face of the converter which mouth rotates in range of 135° about a horizontal axis, the waste gas scavenging system comprising in combination, duct means facing each other adjacent sides of the converter mouth, one on each side, one supply duct means to push pressurized air across the converter mouth to induce and push emanated toxic fumes therefrom to one exhaust duct to pull encountered hot toxic fumes and prevent them from expanding into the working environment, these two said supply and exhaust duct means together defining a push-pull system further including means for moving said push-pull duct system in concert with the mouth about the turning axis of the converter whereby the relationship of the converter mouth and said push-pull system is the same during all angles of movement of the converter mouth, said duct system carried on the converter.

5. The device of claim 4 including an upstream flexible conduit section coupled and providing air to said supply duct means so that relatively cool air is fed to said supply push duct means at all mouth orientations.

6. The device of claim 5 including a swivel conduit section coupled downstream said exhaust duct means to receive hot fumes at all mouth orientations.

7. The device of claim 6 wherein said supply and exhaust duct means respectively include a diverting bypass and a baffle means for altering and matching flow rates as a function of converter mouth positions.

8. The device of claim 7 wherein said exhaust duct means includes a branch exhaust conduit disposed above a conventional stationary gas hood for extracting fumes which meander beyond the mouth of the converter.

9. The device of claim 8 wherein said further branch exhaust conduit communicates with said exhaust extracting means downstream thereof for subsequent processing in an area remote from the converter, said exhaust extracting means sharing scavenging cleansing facilities with the conventional gas hood.

10. The device of claim 9 wherein said intake means comprises a manifold having a plurality of openings, said manifold adjacent an edge of the converter mouth, said manifold communicating with a conduit system to a source of air.

11. The device of claim 10 wherein said intake means includes a source of fluid pressure including a pump and a motor driving said pump through a belt means.

12. The device of claim 11 wherein said exhaust extracting means includes a pump to extract air and a motor to drive said pump operatively connected to said pump by a belt.

13. The device of claim 12 wherein said intake means includes a manifold of substantially elongate rectangular section formed as an arcuate conduit having the same radius of curvature as the converter, said rectangular section having a top wall, a bottom wall and a side wall, a face opposite said side wall provided with a nozzle opening.

14. The device of claim 13 wherein said nozzle opening includes a bottom wall, a pair of side walls and a downwardly declinated top wall inclined downwardly towards the converter mouth.

15. The device of the claim 14 wherein said exhaust manifold includes an arcuate conduit having substantially rectangular cross-section including a top wall, a bottom wall, a side wall, a side opposite said side wall provided with a wall brace and an opening, whereby air pressure causes exhaust gases to enter therein.

16. The device of claim 15 including damper means on said manifolds to alter flow patterns.

* * * * *